US010192707B2

(12) United States Patent
Lin

(10) Patent No.: US 10,192,707 B2
(45) Date of Patent: Jan. 29, 2019

(54) FUSE ASSEMBLY WITH REPLACEABLE CASING

(71) Applicant: Yue-Zhi Lin, Taichung (TW)

(72) Inventor: Yue-Zhi Lin, Taichung (TW)

( * ) Notice: Subject to any disclaimer, the term of this patent is extended or adjusted under 35 U.S.C. 154(b) by 0 days.

(21) Appl. No.: 15/879,658

(22) Filed: Jan. 25, 2018

(65) Prior Publication Data

US 2018/0151322 A1 May 31, 2018

Related U.S. Application Data

(63) Continuation-in-part of application No. 15/161,288, filed on May 23, 2016, now abandoned.

(51) Int. Cl.
*H01H 85/32* (2006.01)
*H01H 85/56* (2006.01)
*H01H 85/175* (2006.01)

(52) U.S. Cl.
CPC ..... *H01H 85/32* (2013.01); *H01H 85/175* (2013.01); *H01H 85/56* (2013.01)

(58) Field of Classification Search
CPC ..... H01H 85/32; H01H 85/175; H01H 85/56
USPC ..... 337/264
See application file for complete search history.

(56) References Cited

U.S. PATENT DOCUMENTS 988,891 A * 4/1911 Mitchell ..... G01R 31/07 324/550
2,062,669 A * 12/1936 La Mar ..... H01H 85/32 235/98 A
2,074,921 A * 3/1937 Kauffman ..... H01H 85/32 337/242
2,157,777 A * 5/1939 Stoffel ..... H01H 85/32 337/242
2,175,919 A * 10/1939 Schiller ..... H01H 85/32 337/242
2,175,987 A * 10/1939 Dodge ..... H01H 85/32 337/186
2,206,784 A * 7/1940 Linton ..... H01H 85/32 337/242
3,432,789 A * 3/1969 Poehlman, Jr. ..... H01H 85/56 337/186
5,739,737 A * 4/1998 Hatton ..... H01H 85/26 337/206
7,460,004 B1 * 12/2008 Yang ..... H01H 85/0417 337/186
7,570,147 B2 * 8/2009 Muller ..... H01H 85/32 337/206

* cited by examiner

*Primary Examiner* — Anatoly Vortman
(74) *Attorney, Agent, or Firm* — Rosenberg, Klein & Lee

(57) ABSTRACT

A fuse assembly includes a casing having two slots defined through the first end thereof, and a conductive member is located in the casing and has a first end extending through the second end of the casing. The conductive member includes two blades with a fuse connected therebetween. A cap is detachably mounted to the first end of the casing and has a light member connected thereto. The light member has a leg portion which is electrically connected to a second end of the conductive member. The cap includes two arms which are detachably hooked to two positioning members on two sides of the casing to ensure the connection between the cap and the casing. When the fuse is burned off, the light member lights on, the cap is removed from the casing, and is detachably connected to a new casing with a functional fuse therein.

4 Claims, 7 Drawing Sheets

FUSE ASSEMBLY WITH REPLACEABLE CASING

The present invention is a Continuation-In-Part application of the applicant's former patent application Ser. No. 15/161,288, filed on May 23, 2016.

BACKGROUND OF THE INVENTION

1. Fields of the Invention

In order to acknowledge the users that the fuse is burned and the circuit is off, a light member is connected with the fuse. When an abnormal current is going to pass through the circuit of an appliance, the fuse is burned to protect the appliance and the light member lights on to acknowledge the users. This type of fuse arrangement can be often seen in vehicle fuses.

2. Descriptions of Related Art

However, once the fuse is burned, the whole fuse assembly including the light member is replaced, although the light member is not damaged. The amount of the discarded light members can become a burden on the environment.

U.S. Pat. No. 5,701,118 to Hull et al. and U.S. Pat. No. 4,499,447 to Greenberg respectively disclose a fuse assembly with an indicator which lights on when the fuse is burned, so that the users can easily tell which fuse needs to be replaced. When installing or removing the fuse assemblies, the users have to grab the fuse assemblies in a narrow space to connect the fuse assemblies to the correct electronic parts. However, there is no feature designed to ensure that the cap is correctly positioned to the case during installation and removal. In other words, the cap may be moved due to impact so that the blades are not in contact with the legs of the light or indicator on the cap properly.

The present invention intends to provide a fuse assembly wherein the cap includes two arms that hook to the positioning members on the body so as to secure the connection between the cap and the casing.

SUMMARY OF THE INVENTION

The present invention relates to a fuse assembly and comprises a casing having two slots defined through the first end thereof. The casing includes a room defined therein which communicates with the two slots. Two protrusions extend from the inside of the room. The casing has two positioning members on two sides thereof.

A conductive member is located in the casing and the first end of the conductive member extends through the open second end of the casing. The conductive member includes two blades which are located with a gap formed therebetween. A fuse is connected between the two blades. Each of the two blades has a hole, and the two protrusions are engaged with the two holes of the two blades.

A cap has an open bottom which is detachably mounted to the first end of the casing. Two arms respectively extend from two ends of the cap, and each arm has a hook end. The two hook ends are detachably hooked to the two positioning members.

A light member is connected to the cap and has a bulb and a leg portion which is electrically connected to the bulb. The leg portion is electrically connected to the second end of the conductive member.

Preferably, the leg portion of the light member has two legs, and is electrically connected to the bulb. The two legs extend through the slots and are electrically connected to the two blades.

Preferably, the cap has at least one anti-slip face defined in the outside thereof.

Preferably, the casing has two insertion recesses defined through the first end thereof. Each of the insertion recesses has one of the positioning members formed in the inside surface thereof. The two arms are inserted into the two insertion recesses and the two hook ends are detachably hooked to the two positioning members.

Preferably, the casing includes a window defined through the wall of each of the two sides thereof, and the window communicates with the insertion recess corresponding thereto.

The primary object of the present invention is to provide a fuse assembly wherein the cap with the light member can be reused, and only the casing is replaced. The light member is not discarded and re-used to protect the environment from being polluted by the discarded light members.

Another object of the present invention is to provide a fuse assembly wherein the cap is secured once mounted to the casing to prevent loosening from impact.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
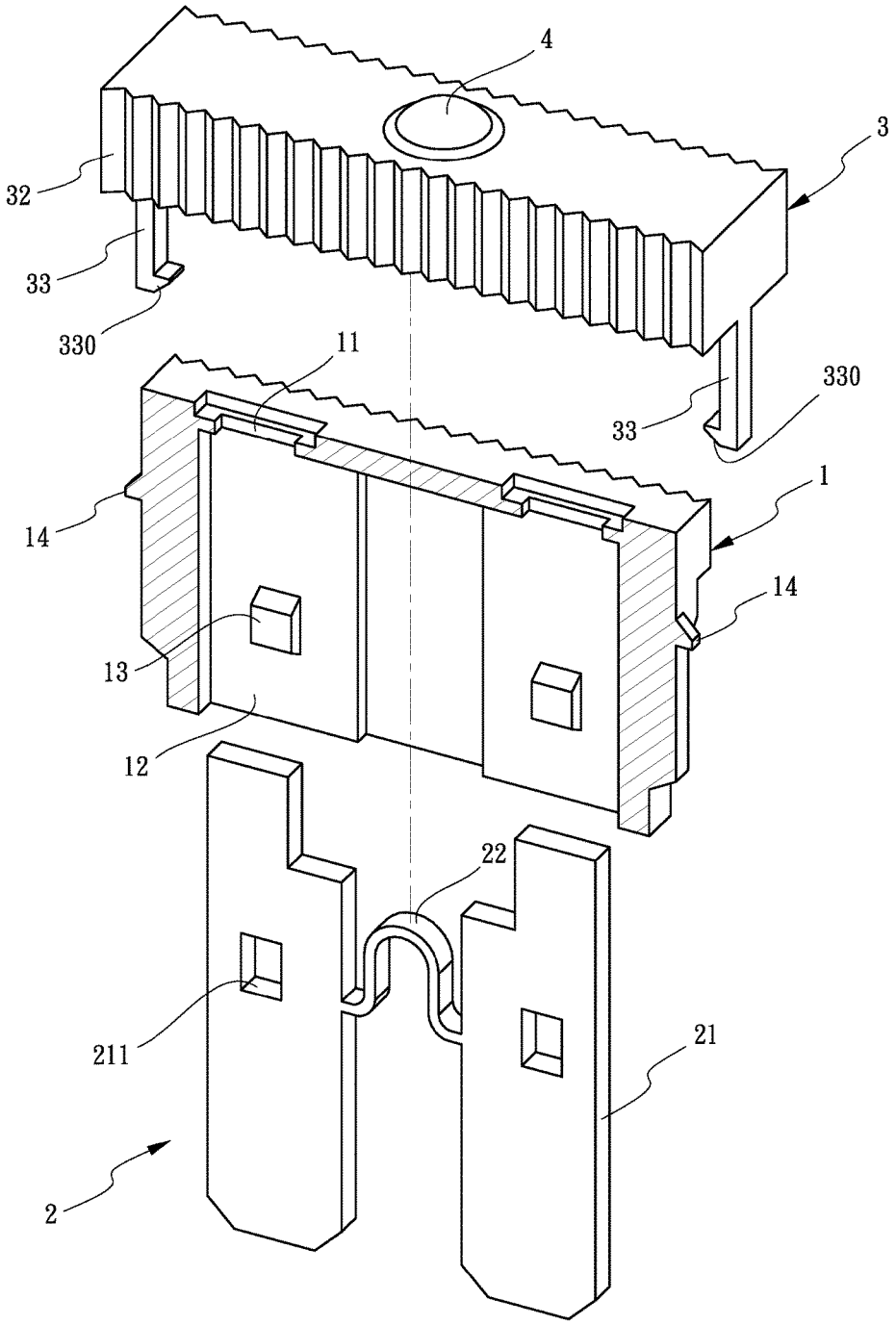
FIG. 1 is an exploded view of the fuse assembly of the present invention.
Figure 2:
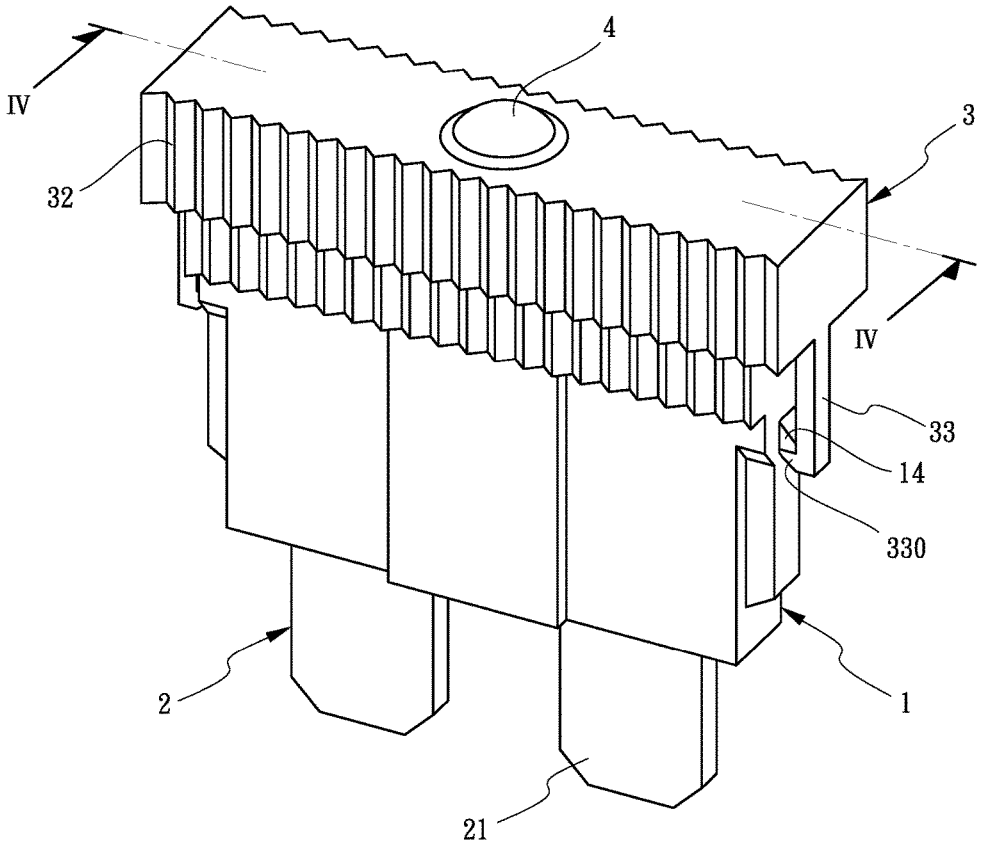
FIG. 2 is a perspective view to show the fuse assembly of the present invention.
Figure 3:
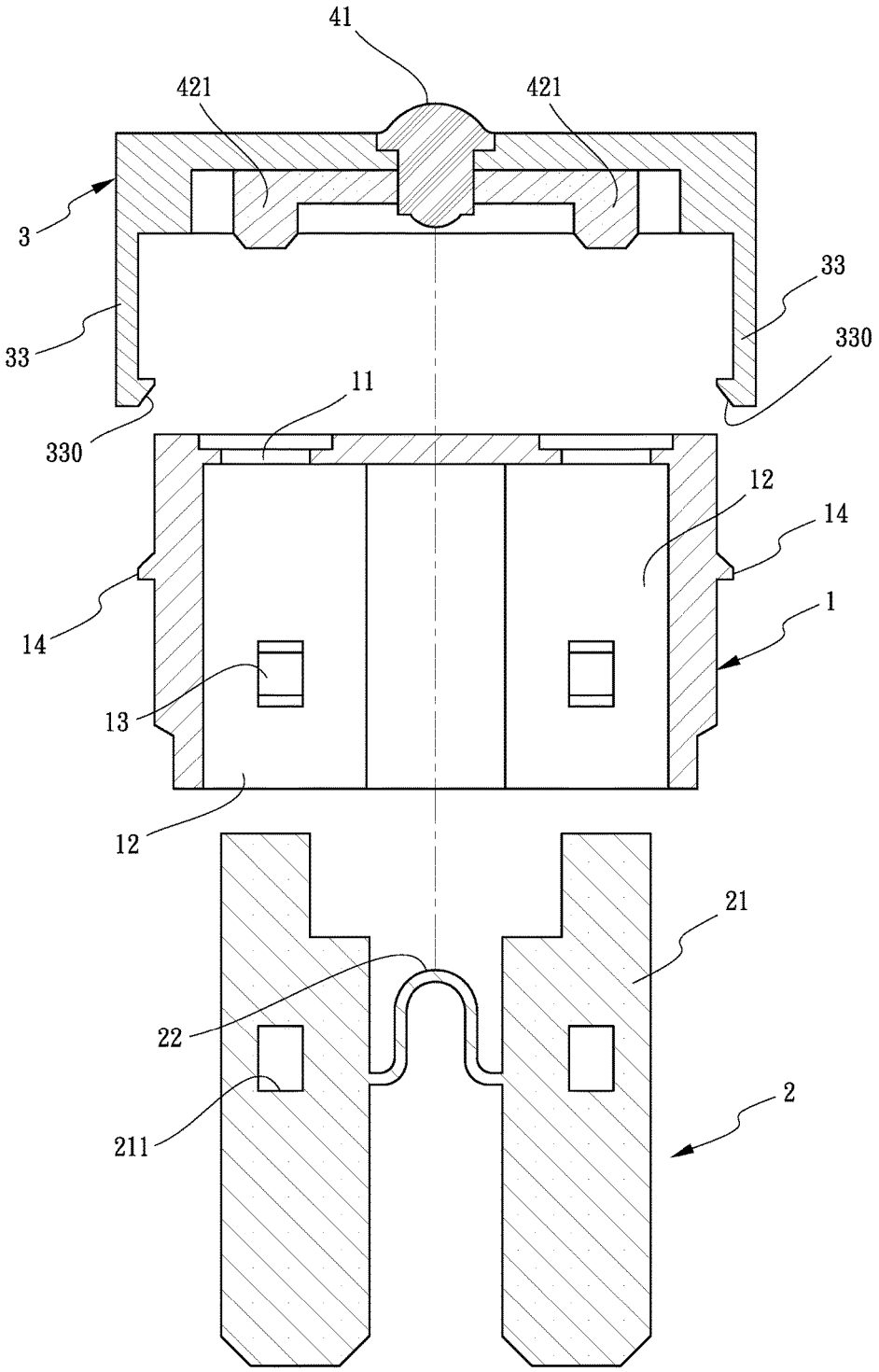
FIG. 3 is a cross sectional view to show the cap, the casing and the conductive member of the fuse assembly of the present invention.
Figure 4:
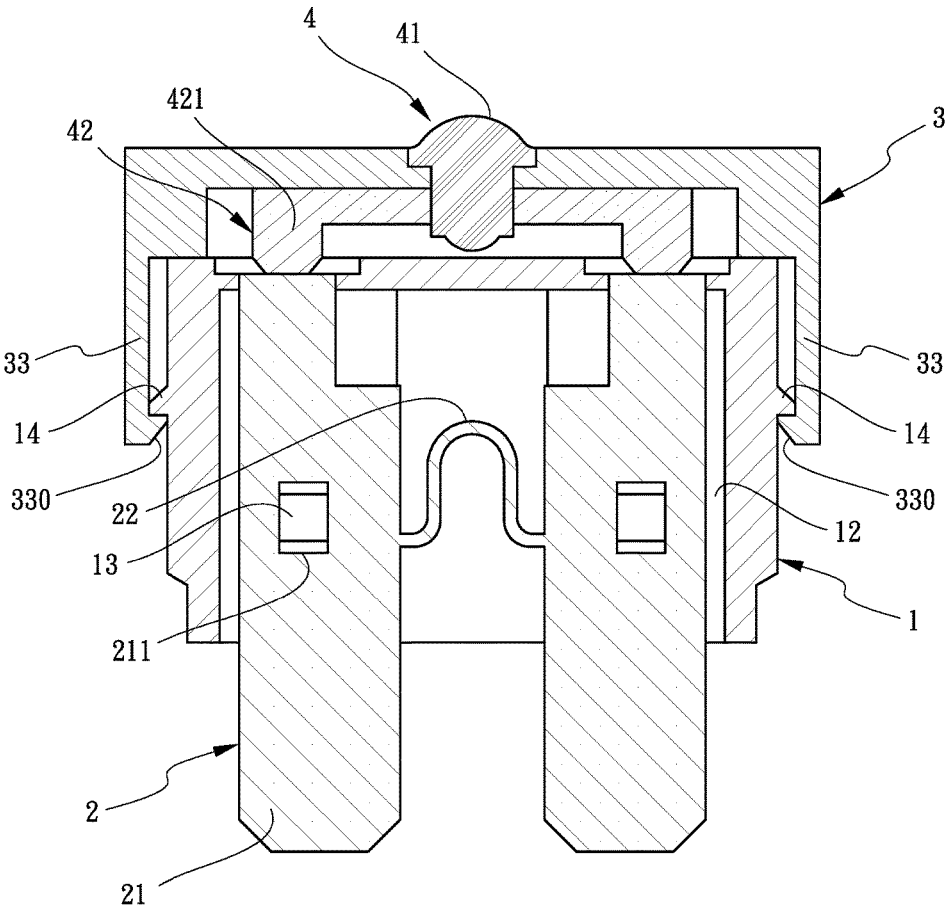
FIG. 4 is a cross sectional view, taken along line IV-IV in FIG. 2.
Figure 5:
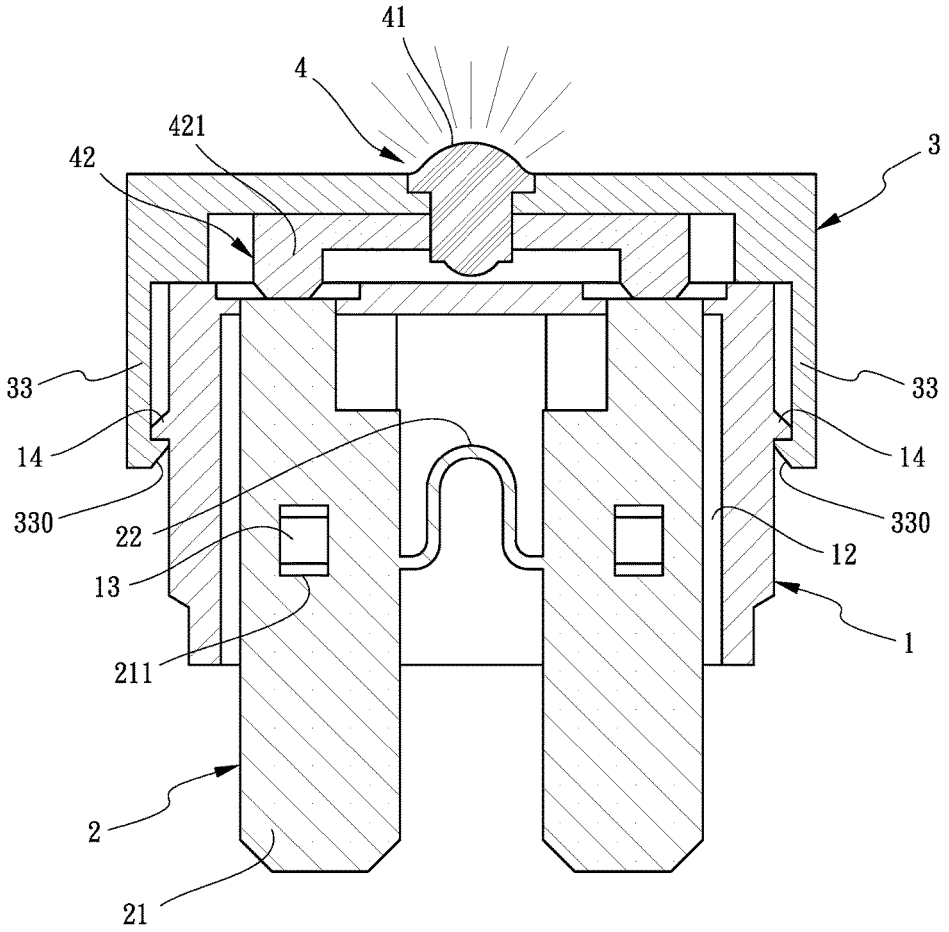
FIG. 5 is a cross sectional view to show that the light member lights on when the fuse is burned off.

Referring to FIGS. 1 to 5, the fuse assembly of the present invention comprises a casing 1 which has two slots 11 defined through the first end thereof. A room 12 is defined in the casing 1 and communicates with the two slots 11. Two protrusions 13 extend from the inside of the room 12. The casing 1 includes two positioning members 14 on two sides thereof.

A conductive member 2 is located in the casing 1 and includes two blades 21 which are located with a gap formed therebetween. A fuse 22 is connected between the two blades 22. The first end of each of the two blades 21 extends through the correspondent second end of the casing 1. The second end of each of the two blades 21 is located corresponding to the slot 11 corresponding thereto.

A cap 3 has an open bottom 31 and is detachably mounted to the first end of the casing 1. Two arms 33 respectively extend from two ends of the open bottom 31 of the cap 3 and each arm 33 has a hook end 330. A light member 4 is connected to the cap 3 and has a bulb 41 and a leg portion 42 which is electrically connected to the bulb 41. The leg portion 42 is an elongate plate which has two legs 421. The two legs 421 extend through the slots 11 and are electrically connected to the two blades 21. Each of the two blades 22 has a hole 211, and the two protrusions 13 are engaged with the two holes 211 of the two blades 22 so as to position the two blades 22 in the room 12. Preferably, the cap 3 has at least one anti-slip face 32 defined in the outside thereof. When the cap 3 is detachably mounted to the first end of the casing 1, the two hook ends 330 are detachably hooked to the two positioning members 14 so that the cap 3 is not loosened due to impact. The engagement between each pair of the hook end 330 and the positioning member 14 also ensures that the two legs 421 extend through the slots 11 and are electrically connected to the two blades 21 as expected. It is also noted that the cap 3 is mounted to the casing 1 or removing from the casing 1 along the axial direction of the casing 1.

The fuse assembly of the present invention is used for electronic parts of vehicles, and when the light member 4 lights on, this means that an abnormal current burns off the fuse 22. The light member 4 acknowledges the users to check and fix the problem. When replacing with a new fuse, the user detaches the cap 3 from the casing 1, and connects the cap 3 to a new casing 1 with a functional fuse 22. The at least one anti-slip face 32 defined in the outside of the cap 3 allows the user to grab the cap 3 easily.

Because the cap 3 with the light member 4 can be reused, and only the casing 1 is replaced, so that the light member 4 is not discarded, and can be re-used to protect the environment from being polluted by the discarded light members 4. The two blades 21 of the conductive member 2 are well positioned by engaging the protrusions 13 with the holes 211 of the two blades 21, so that the two blades 21 are easily plugged to the parts cooperated with the fuse assembly.

Figure 6:
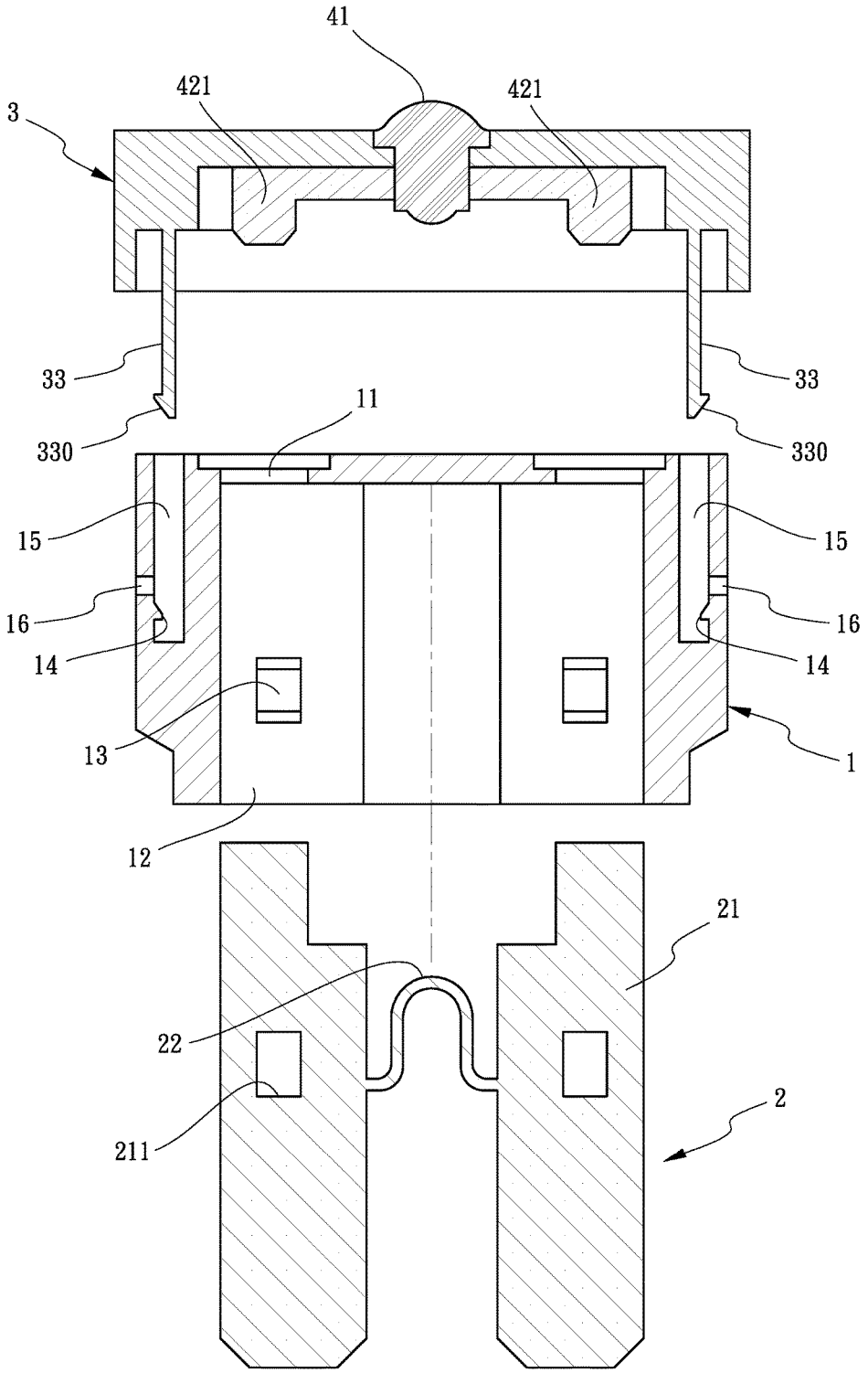
FIG. 6 shows the second embodiment of the present invention.
Figure 7:
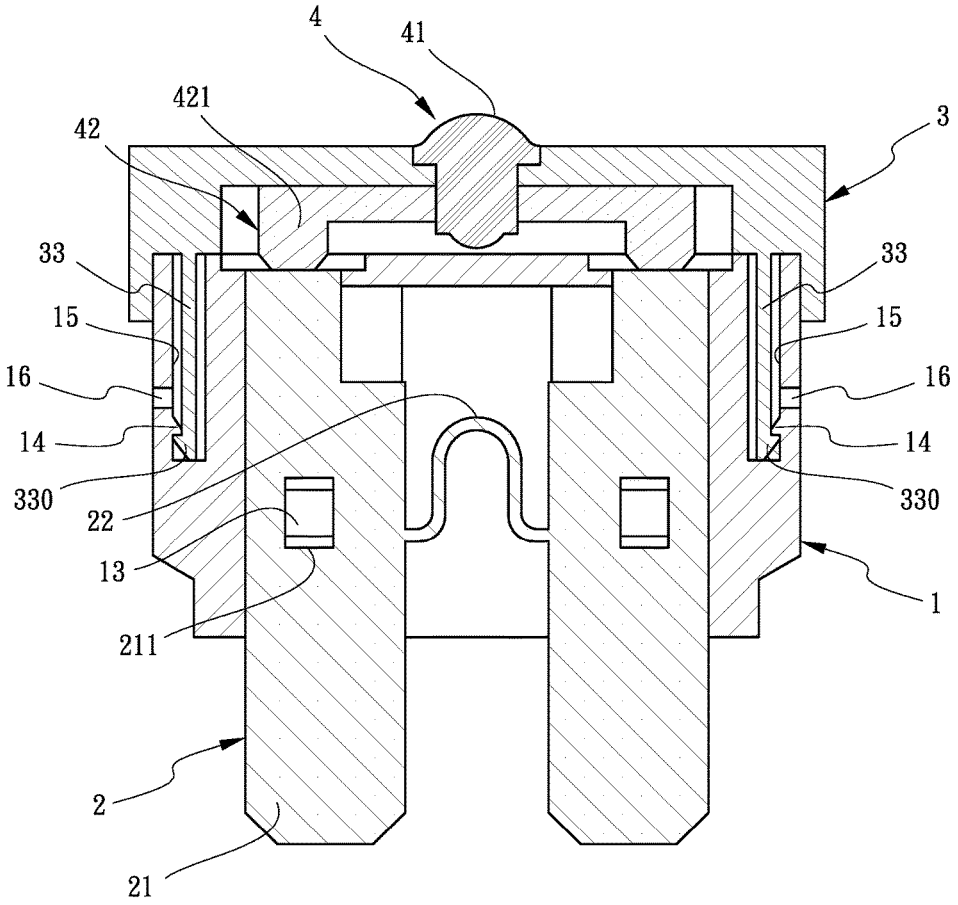
FIG. 7 shows that the arms are hidden in the insertion recesses, and the hook ends of the arms are not accidentally separated from the positioning members.

As shown in FIGS. 6 and 7, a second embodiment is disclosed, wherein the casing 1 includes two insertion recesses 15 defined through the first end thereof. The two slots 11 are located between the two insertion recesses 15. Each of the insertion recesses 15 has one of the positioning members 14 formed in the inside surface thereof. The two arms 33 are inserted into the two insertion recesses 15 and the two hook ends 330 are detachably hooked to the two positioning members 14 when the cap 3 is mounted to the casing 1. The casing 1 includes a window 16 defined through the wall of each of the two sides thereof, and the window 16 communicates with the insertion recess 15 corresponding thereto. Therefore, when replacing the casing 1, the user may insert an object (not shown) into the window 16 to push the hook end 330 away from the positioning member 14 to separate the cap 3 from the casing 1. That is to say, the arms 33 are hidden in the insertion recesses 15 so that the hook ends 330 of the arms 33 are not accidentally separated from the positioning members 14, and the users have to use an object (not shown) to insert into the windows 16 to separate the hook ends 330 of the arms 33 from the positioning members 14.

While we have shown and described the embodiment in accordance with the present invention, it should be clear to those skilled in the art that further embodiments may be made without departing from the scope of the present invention.

What is claimed is:

1. A fuse assembly comprising:

a casing having two slots defined through a first end thereof, the casing having a room defined therein which communicates with the two slots, two protrusions extending from an inside of the room, the casing having two insertion recesses defined through the first end thereof, each of the insertion recesses having a positioning member formed in an inside surface thereof;

a conductive member located in the casing and having a first end extending through a second end of the casing, the conductive member including two blades which are located with a gap formed therebetween, a fuse connected between the two blades, each of the two blades having a hole, the two protrusions engaged with the two holes of the two blades;

a cap having an open bottom which is detachably mounted to the first end of the casing, two arms respectively extending from two ends of the cap and each arm having a hook end, the two arms inserted into the two insertion recesses and the two hook ends being detachably hooked to the two positioning members, and a light member connected to the cap and having a bulb and a leg portion which is electrically connected to the bulb, the leg portion being electrically connected to a second end of the conductive member.

2. The fuse assembly as claimed in claim 1, wherein the leg portion of the light member has two legs, the leg portion is electrically connected to the bulb, the two legs extend through the slots and are electrically connected to the two blades.

3. The fuse assembly as claimed in claim 1, wherein the cap has at least one anti-slip face defined in an outside thereof.

4. The fuse assembly as claimed in claim 1, wherein the casing includes a window defined through a wall of each of the two sides thereof, and the window communicates with the insertion recess corresponding thereto.

* * * * *